US010876330B1

(12) United States Patent
Anderson

(10) Patent No.: US 10,876,330 B1
(45) Date of Patent: Dec. 29, 2020

(54) DEVICE FOR SECURING FRENCH DOOR IN DESIRED POSITION

(71) Applicant: Derek Anderson, Morgan Hill, CA (US)

(72) Inventor: Derek Anderson, Morgan Hill, CA (US)

( * ) Notice: Subject to any disclaimer, the term of this patent is extended or adjusted under 35 U.S.C. 154(b) by 11 days.

(21) Appl. No.: 16/255,554

(22) Filed: Jan. 23, 2019

Related U.S. Application Data

(60) Provisional application No. 62/621,474, filed on Jan. 24, 2018.

(51) Int. Cl.
*E05C 17/00* (2006.01)
*E05C 17/54* (2006.01)

(52) U.S. Cl.
CPC ..... *E05C 17/025* (2013.01); *E05C 17/54* (2013.01); *E05Y 2900/132* (2013.01)

(58) Field of Classification Search
CPC ..... E05C 17/025; E05C 17/54; E05C 17/02
See application file for complete search history.

(56) References Cited

U.S. PATENT DOCUMENTS 1,159,036 A * 11/1915 Iversen ..... E05C 17/54 292/344
4,017,939 A * 4/1977 Schofield ..... B32B 15/08 16/82
4,878,267 A * 11/1989 Roach ..... E06B 7/367 16/250
5,027,471 A * 7/1991 Barnes ..... E05D 11/00 16/86 R
5,044,681 A * 9/1991 Neighbors ..... E05C 17/025 16/319
5,450,652 A * 9/1995 Webb ..... E05C 17/025 16/82
5,511,837 A * 4/1996 Dempsey ..... E05C 17/025 16/319
5,680,675 A * 10/1997 Davis ..... E05C 17/025 16/83
5,711,557 A * 1/1998 Nicolosi ..... E05C 17/54 16/82
6,035,487 A * 3/2000 Simon ..... E05F 5/06 16/86 A
7,374,213 B2 * 5/2008 Carlson ..... E05C 17/025 292/343
7,506,905 B1 * 3/2009 George ..... E05C 17/025 16/82
8,458,958 B2 * 6/2013 Cress ..... E05F 5/04 49/462
8,863,561 B2 * 10/2014 Orlov ..... E05C 19/182 16/375
8,869,451 B2 * 10/2014 Belyea ..... E06B 7/362 16/82

(Continued)

*Primary Examiner* — Victor D Batson
*Assistant Examiner* — Matthew J Sullivan
(74) *Attorney, Agent, or Firm* — Plager Schack LLP; Mark H. Plager; Kara Verryt

(57) ABSTRACT

A door stop assembly for securing a door in a desired position may include a block portion; and an arm portion extending from the block portion at an angle, wherein the arm portion may be sized to fit within a space between a door jamb and a door. The device may also include a top cap and a bottom cap made of, for example, a non-slip material to prevent or reduce slipping of the device during use.

6 Claims, 3 Drawing Sheets

(56) References Cited

U.S. PATENT DOCUMENTS

| | | | | |
|---|---|---|---|---|
| 8,914,945 | B2 * | 12/2014 | Callahan | E05F 5/02 16/82 |
| 8,955,891 | B2 * | 2/2015 | Millsap | E05C 17/025 16/82 |
| 8,960,739 | B2 * | 2/2015 | Duff | E05C 17/025 16/86 A |
| 9,127,489 | B2 * | 9/2015 | Orlov | E05C 17/025 |
| 2005/0212017 | A1 * | 9/2005 | Heisserer | A01K 1/0017 257/257 |
| 2007/0126248 | A1 * | 6/2007 | Mintz | E05C 17/025 292/342 |
| 2008/0277949 | A1 * | 11/2008 | Emde | E05C 17/025 292/343 |
| 2010/0038921 | A1 * | 2/2010 | Kirkham | E05C 17/025 292/343 |
| 2014/0183883 | A1 * | 7/2014 | Millsap | E05C 17/54 292/288 |
| 2017/0226782 | A1 * | 8/2017 | Holden | E05C 17/54 |
| 2018/0128027 | A1 * | 5/2018 | Seamans | E05C 17/54 |
| 2019/0136593 | A1 * | 5/2019 | McCallister | E05C 17/56 |

* cited by examiner

DEVICE FOR SECURING FRENCH DOOR IN DESIRED POSITION

RELATED APPLICATION

This application claims priority to provisional patent application U.S. Ser. No. 62/621,474 filed on Jan. 24, 2018, the entire contents of which is herein incorporated by reference.

BACKGROUND

The embodiments herein relate generally to devices, such as door stops, for keeping doors open, and more particularly, to a device for securing a French door in a desired position.

Existing French door stops are invasive to the door's original integrity. Some existing stops are also obtrusive eyesores. Additionally, when it comes to existing devices, one size does not fit all, and users are often left to using rocks or other fixed items, such as sandbags, which can ruin the integrity of the door and door frame.

Therefore, what is needed is a door stop for French doors, wherein the door stop keeps the French doors open while simultaneously maintaining the original intent of the door without comprising the door's quality, integrity, look, or value.

SUMMARY

Some embodiments of the present disclosure include a door stop assembly for securing a door in a desired position. The door stop assembly may include a block portion; and an arm portion extending from the block portion at an angle, wherein the arm portion may be sized to fit within a space between a door jamb and a door. The device may also include a top cap and a bottom cap made of, for example, a non-slip material to prevent or reduce slipping of the device during use.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
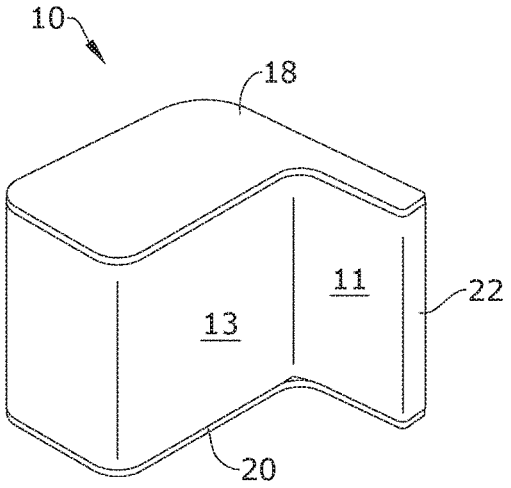
FIG. 1 is a perspective view of one embodiment of the present disclosure.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as door stop for doors, such as French doors, and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

a. Inner Body b. Outer Covering

The various elements of the device of the present disclosure may be related in the following exemplary fashion. It is not intended to limit the scope or nature of the relationships between the various elements and the following examples are presented as illustrative examples only.

By way of example, and referring to FIGS. 1-6, some embodiments of the present disclosure include a door stop assembly 10 for securing a door, such as a French door 24, in a desired position, the door stop assembly 10 comprising an arm portion 11 and a block portion 13, wherein the arm portion 11 extends from a block portion 13 at an angle, and the arm portion 11 is sized to fit within a space between a door jamb 26 and a door 24. Specifically, in embodiments the door stop assembly 10 may comprise an inner body defining the shape of the door stop assembly 10 (i.e., forming the block portion 13 and the arm portion 11) and an outer covering 22 enveloping the inner body. For example, the outer covering 22 may cover sidewalls of the inner body and may have an open top and bottom, while a top cap 18 may cover a top planar surface of the inner body, and a bottom cap 20 may cover a bottom lower surface of the inner body.

Figure 2:
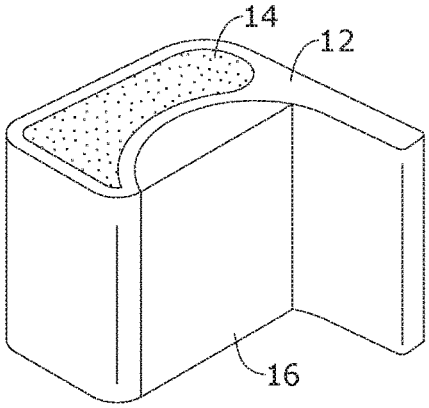
FIG. 2 is a perspective view of one embodiment of the present disclosure.
Figure 3:
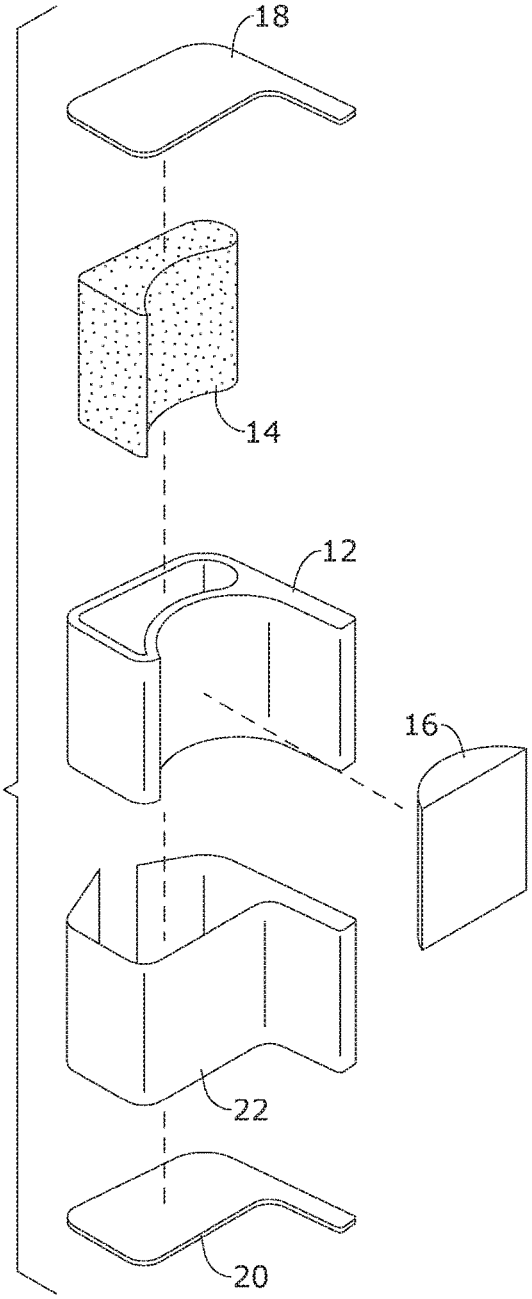
FIG. 3 is an exploded view of one embodiment of the present disclosure.

As shown in the Figures, the inner body may ultimately define the block portion 13 and arm portion 11 of the door stop assembly. The inner body may be a singular assembly or, alternatively, the inner body may comprise a plurality of components fit together to form the final block portion 13/arm portion 11 shape. For example, as shown in FIGS. 2 and 3, the inner body may comprise a frame 12 with an insert orifice extending therethrough, the frame 12 being substantially J-shaped; an insert 14 positioned within the insert orifice in the frame 12; and a plug 16 fit within the concave portion of the J-shape of the frame 12. When the plug 16 is positioned within the concave portion of the frame 12, the plug 16 and the frame 12 together may define the outer shape of the door stop assembly 10, wherein the block portion 13 comprises the "base" of the J-shape along with the plug 16 and the arm portion 11 comprises the upwardly extending portion of the J-shape. Thus, the plug 16 may be substantially semi-circular or half-moon in shape. The block portion 13, as seen in the Figures, may be substantially rectangular in shape. In some embodiments, the block portion 13 may be a rounded rectangular block. The arm portion 11 may extend from the block portion 13 at any desired angle. In some embodiments, and as shown in the Figures, the arm portion 11 may be substantially perpendicular to an outer surface of the plug 16 and in line with a wall of the frame 12. In other embodiments, the arm portion 11 may extend from the block portion 13 at other various angles.

While not shown in the Figures, some embodiments of the door stop assembly 10 further comprise a scratch preventing grip attached to an end of the arm portion 11 distal from the block portion 13. The scratch preventing grip may prevent scratches to the door 24 while the door stop assembly 10 is in use.

The door stop assembly 12 of the present disclose may be made of any desired materials. In some embodiments, the frame 12 may comprise metal, such as steel, or another rigid material, such as polyethylene or polyurethane. The insert 14 may comprise a cushioning material, such as Styrofoam, or a polyethylene or polyurethane material. The plug 16 may comprise a polyethylene or polyurethane material or any other desired material. In embodiments, the components of the inner body may comprise the same materials or different materials. The outer covering 22 is not limited in materials and, in some embodiments, may comprise a polyurethane material. Similarly, the top cap 18 and bottom cap 20 are not particular limited in material and, in some embodiments, may each comprise a non-slip material and, thus, may help prevent the door stop assembly 10 from slipping during use.

While not shown in the Figures, the door stop assembly 10 of the present disclosure may further comprise additional optional features. For example, the door stop assembly 10 may comprise a chip or other material built therein to sense and report wind speed, humidity, outside temperature, or the like. Additionally, the door stop assembly 10 may have a built-in music or Bluetooth speaker device. Moreover, the door stop assembly 10 may have a built in alarm feature.

Figure 4:
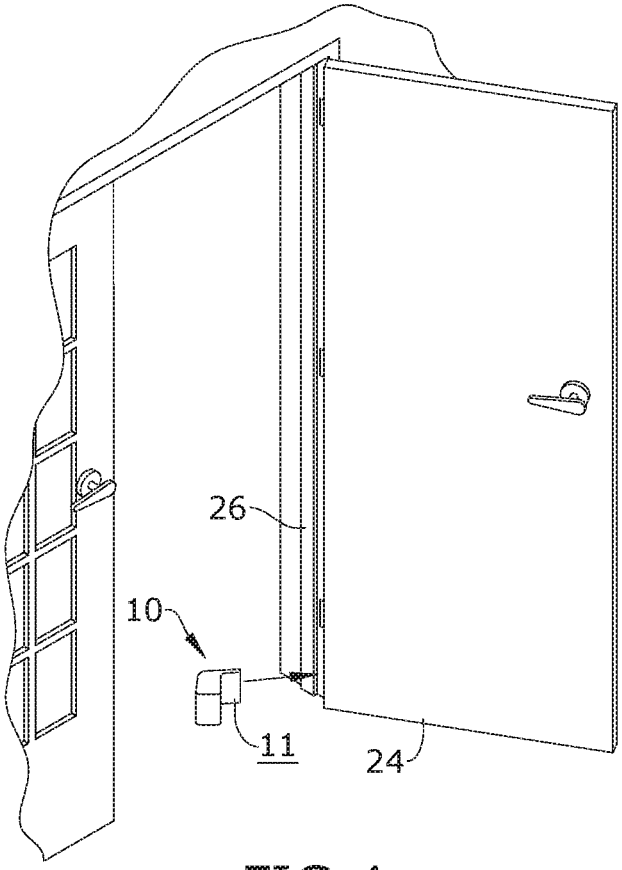
FIG. 4 is a perspective view of one embodiment of the present disclosure.
Figure 5:
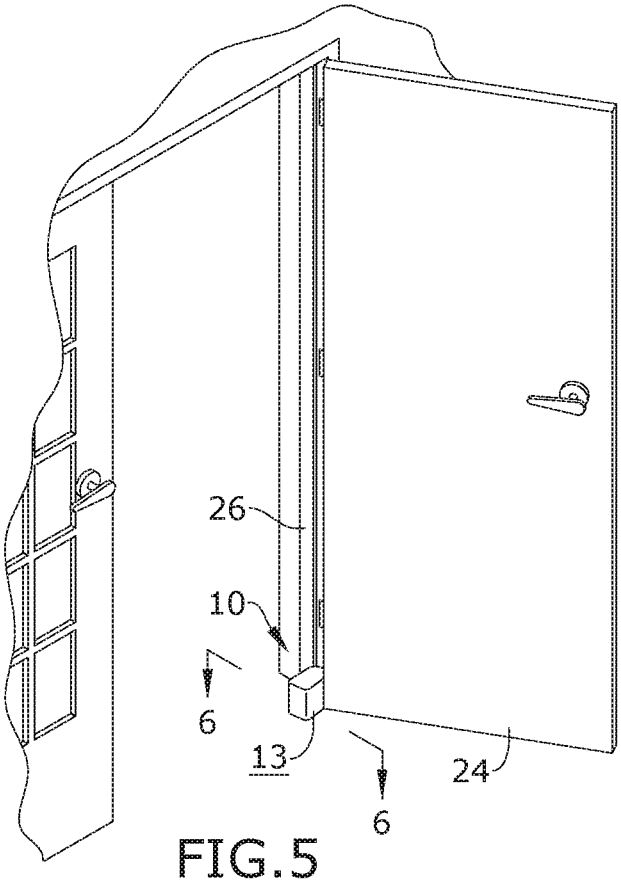
FIG. 5 is a perspective view of one embodiment of the present disclosure, shown in use.
Figure 6:
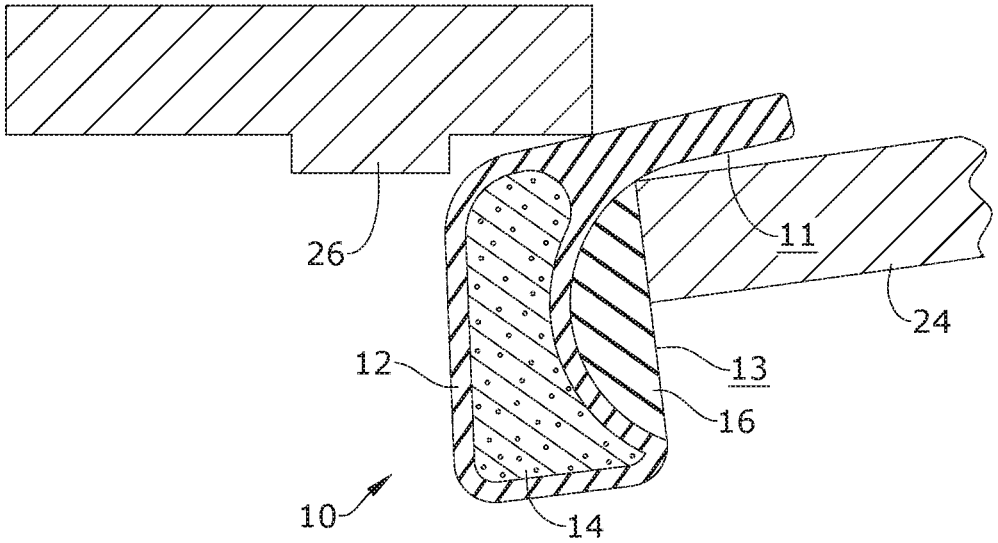
FIG. 6 is a section view of one embodiment of the present disclosure, taken along line 6-6 in FIG. 5.

To use the door stop assembly 10 of the present disclosure, the door stop assembly 10 may be positioned such that the arm portion 11 is inserted into the space between a door jamb 26 and the edge of the door 24, as shown in FIGS. 4-6. By positioning it correctly, the door stop assembly 10 may prevent the door 24 from moving out of a desired position.

Because of the structure of the door stop assembly 10, the door stop assembly 10 may secure the door 24, wherein the door stop assembly 10 may also allow for up to 30% movement in a first direction and less than about 5% movement in the opposite direction (toward the arm portion 11). Specifically, the door stop assembly 10 may provide for or allow for this range of movement in windy situations (up to about 25 to 30 mph winds) without compromising the door frame or the actual door itself. Additionally, because of the structure of the door stop assembly 10, the door or frame may be unable to come to a complete halt or stop (slam or abrupt closure), meaning that the door is unable to slam in either direction when the door stop assembly 10 of the present disclosure is being used.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A door stop assembly for securing a door in a desired position, the door stop assembly comprising:

a block portion;

an arm portion extending from the block portion at an angle;

an inner body defining the block portion and the arm portion, wherein the inner body comprises:

a frame with an insert orifice extending therethrough, the frame being substantially J-shaped;

an insert positioned within the insert orifice in the frame; and a plug fit within a concave portion of the J-shape of the frame; and an outer covering enveloping the inner body, wherein the arm portion is sized to fit within a space between a door jamb and a door.

2. The door stop assembly of claim 1, further comprising a planar top surface and a planar bottom surface, wherein the planar bottom surface is designed to be positioned against a ground surface.

3. The door stop assembly of claim 1, further comprising:

a planar top surface and a planar bottom surface, wherein the planar bottom surface is designed to be positioned against a ground surface;

a top cap covering the planar top surface; and a bottom cap covering the planar bottom surface.

4. The door stop assembly of claim 3, wherein the top cap and the bottom cap each comprise a non-slip material.

5. The door stop assembly of claim 1, wherein:

the plug is substantially semi-circular in shape; and the block portion has a rounded rectangle.

6. The door stop assembly of claim 1, wherein the door stop assembly comprises a material selected from the group consisting of polyethylene and polyurethane.

* * * * *